United States Patent [19]

Owan

[11] 4,036,474

[45] July 19, 1977

[54] PORTABLE JACK

[76] Inventor: Vernon L. Owan, Highway Nos. 2 & 85 North, Williston, N. Dak. 58801

[21] Appl. No.: 696,216

[22] Filed: June 15, 1976

[51] Int. Cl.[2] ..... B66F 3/00

[52] U.S. Cl. ..... 254/124

[58] Field of Search ..... 254/2 R, 2 B, 2 C, 8 R, 254/8 B, 8 C, 9 R, 9 B, 9 C, 120, 124, 126

[56] References Cited

U.S. PATENT DOCUMENTS

| | | | |
|---|---|---|---|
| 2,687,873 | 8/1954 | Travtman et al. | 254/126 |
| 3,378,231 | 4/1968 | Rapp | 254/124 |
| 3,819,153 | 6/1974 | Hurst et al. | 254/124 |
| 3,907,252 | 9/1975 | Gaarder | 254/8 B |

FOREIGN PATENT DOCUMENTS

| | | | |
|---|---|---|---|
| 201,757 | 2/1966 | Sweden | 254/126 |

*Primary Examiner*—James L. Jones, Jr.
*Assistant Examiner*—Robert C. Watson
*Attorney, Agent, or Firm*—James R. Young; John E. Reilly

[57] ABSTRACT

This invention is directed to a wheel-mounted portable jack which is capable of lifting large objects from a minimum ground clearance to a considerable height without resetting. The structure of the jack includes an upper member and a lower frame member pivotally attached together and movable between a normally contracted position and an expanded position under the control of lift means extending between a base and the upper frame. The lift means is operative to actuate the frame members simultaneously to advance from a collapsed or closed position in which the frame members are in parallel, horizontal relation to each other to an extended or open position in which the frame members approach a vertical, straight line relation to each other resembling the opening of a set of jaws. The jack includes a self-contained power source, drive means, and control apparatus as well as an apparatus for lifting the rear end of the jack for alignment purposes, a handle, and wheels for convenience in transporting the jack.

19 Claims, 9 Drawing Figures

PORTABLE JACK

BACKGROUND OF THE INVENTION

The present invention is related to devices for lifting large objects, and more specifically to portable jacks adaptable for lifting bulky objects from a position near the ground to some distance above the ground.

Many types of lifting jacks have been developed in the past for lifting heavy objects including screw jacks, screw-type scissor jacks, mechanical pawl and ratchet jacks, hydraulic cylinder jacks, air cylinder jacks, and modifications of these jacks using various mechanisms and configurations of levers for adaption to specific purposes. Since the working principle of most jacks is to lift from the underside of bulky objects, some amount of clearance is required to accommodate the mechanism of the jack. Various attempts have been made to overcome or at least minimize this clearance requirement, usually by the use of some lever arrangement to act as a lift limb device. The U.S. Pat. No. 3,685,797 issued to B. E. Orr is an example of such a device. A problem inherent in many simple lever arrangements is that the lever in pivoting about a point causes the loaded or free end of the lever to define an arcuate path as it rises. consequently, either the load must be movable to follow the arcuate path as it is raised, or the base of the jack must be movable to compensate for the arcuate path and the immovability of a load. In the first case, problems result because many loads are simply too large or are immovably attached at an opposite end so that they are not laterally movable. The second alternative may result in instability of the jack as the load is raised, particularly where the base is not on wheels or is on a surface which resists movement.

Another problem encountered in the use of jacks is that the range of lifting is quite limited by the mechanism, frequently requiring blocking the load and resetting the jack to achieve greater heights. The lever-type jacks hve alleviated this problem to some extent; however, it has been found that in attempting to devise jacks with higher lift ranges, the resulting jack apparatus becomes either very bulky and unwieldy or relatively unstable, and in addition is not readily movable between different locations or collapsible into a compact configuration requiring a minimum of space for storage and transportation.

Several prior art patents which have attempted to accommodate some of these desirable features while eliminating the problems include: U.S. Pat. No. 3,582,043 issued to J. Tranchero; U.S. Pat. No. 3,378,231 issued to W. A. Rapp; U.S. Pat. No. 3,361,409 to M. R. Stahl; and U.S. Pat. No. 3,685,797 issued to B. E. Orr. While these prior art patents have been successful to some degree, the present invention is a significant improvement over the prior art not only in lifting range, lifting capacity, and stability, but also in convenience moving, setting and operating, reliability, and compactness for storage and transportation.

SUMMARY OF THE INVENTION

It is therefore an object of the present invention to provide a jack apparatus that is capable of lifting large objects from very little ground clearance to a considerable height without the necessity of resetting.

A further object of the invention is to provide a portable jack which is convenient to use and position, yet maintains its stability in lifting and holding a load high above the surface of the ground.

A still further object of the present invention to provide a jack which is capable of lifting large objects from a low ground clearance in a vertically straight line to a considerable height above the ground while accommodating only the arcuate path, if any, defined by the object being lifted and still able to maintain its stability.

Another object of the present invention is to provide a wheel-mounted jack with self-contained automatic controls for convenience in setting and operating said jack, including speed control means for varying the rate of raising and lowering a load.

An additional object of the present invention is to provide a jack with adjustable load and ground engaging pads adaptable for differing lifting conditions and various loading configurations to provide increased stability and safety and wherein the wheels are movable to an out-of-the-way position automatically in response to movement of the jack into position beneath a load.

Still another object of the present invention is to provide a jack with controllable alignment means for assisting the operator in aligning the jack under a load.

The present invention is directed to a novel jack apparatus for lifting large objects. The jack superstructure may be of the type employed in the truck body hoists manufactured by B.B.P. in Sioux City, Iowa, comprising a compact, pivotally connected dual frame structure with an axially extending and contracting lift means, preferably a hydraulic cylinder and ram. The lower frame member includes a ground support at one end, and the upper frame member includes a load engaging support at one end positioned vertically above said ground engaging pad. The configuration and arrangement of the upper and lower frame members and the pivotally attached hydraulic cylinder is such that the lift jack apparatus is relatively small and compact in the collapsed position; however, the load engaging pad can be extended to relatively great heights in a vertically straight line over the ground-engaging pad while the jack still maintains a high degree of stability. While both the upper and lower frame members are in a substantially horizontal position when in the collapsed position, they both attain a nearly vertical orientation when fully extended. Consequently, the lifting range of the jack is nearly equal to twice the length of each frame member, or described another way, the lifting range is nearly equal to the sum of the individual lengths of both the upper and lower frame members.

Horizontally adjustable pads are provided at both the ground-engaging and the load-engaging ends. These pads can be laterally extended to expand the effective base of both the ground-engaging and the load-engaging ends, and yet they can be contracted for storage or for lifting narrower loads. This mechanism increases the stability of the jack by providing a wider base for lifting. Also, the configurations of both the upper and lower frame members and the methods and locations for pivotally attaching the upper and lower frame members together and for attaching the hydraulic cylinder to both the upper and lower frame members also provides an extremely strong and rigid structure, regardless of how high the jack is extended.

The jack is also provided with wheels mounted on the lower frame member in a location where they contact the ground when the jack is in a collapsed or lowered position but where they are lifted off the ground when the jack is extended for lifting. This wheel arrangement provides for ready carriage by the wheels for moving the collapsed jack, but when a lifting operation is commenced, no additional work or step is required to move the wheels to the out-of-the-way position away from contact with the ground.

Since the jack does not have enough weight within itself to force the ram of the hydraulic cylinder lift means back into the cylinder to allow the jack to collapse, a spring bias means is also provided to collapse the jack thus placing the wheels in contact with the ground. This feature is particularly useful after a raised load has been secured and the jack must be lowered away from the load and removed from the work area.

Automatic controls for the jack lifting mechanism are provided and include a hydraulic pump, selective valve mechanism, hydraulic fluid reservoir, electric motor for driving the hydraulic pump, storage battery for an electrical energy source, and a control switch. The jack can therefore be raised, held in any position, or lowered conveniently and with very little effort. A handle and wheels are also provided to enhance the convenience and maneuverability of the jack while it is not loaded, and an optional feature includes an automatic alignment means to assist the operator in properly aligning the load-engaging pads in position under the load. Once the load is engaged by the jack, however, the wheels and handle serve no purpose since the jack becomes engaged in an extremely rigid position and the wheels are virtually lifted off the ground as the jack is extended and the load is raised.

BRIEF DESCRIPTION OF THE DRAWINGS

Other objects, advantages and capabilities of the present invention will become more apparent as the description proceeds taken in conjunction with the accompanying drawings, in which.

DETAILED DESCRIPTION OF THE PREFERRED EMBODIMENT

Figure 1:
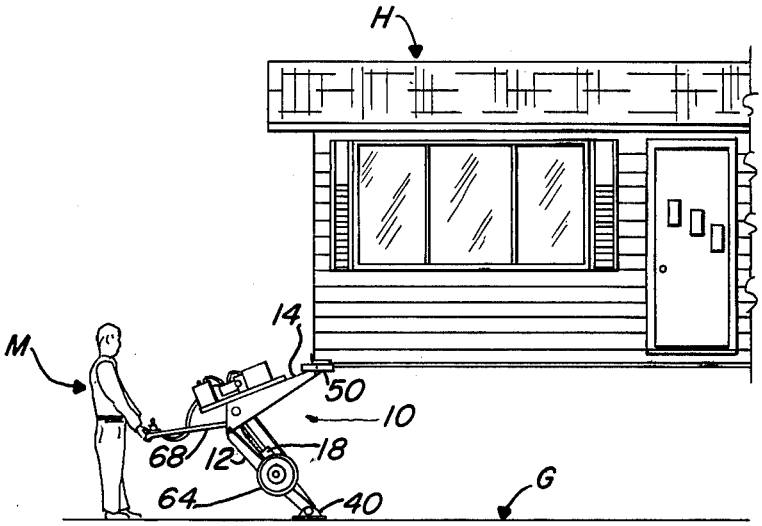
FIG. 1 is an elevation view showing a man with the jack apparatus lifting one end of a house.

A portable jack 10 formed in accordance with the present invention is shown in FIG. 1 engaged in the operation of lifting a house H above the ground G. The operator M is shown standing behind the jack 10 with his hands on the handle 68. Generally, the jack 10 is comprised of a lower frame member 12 pivotally attached at its rear end to an upper frame member 14. A longitudinally expandable and contractable lift member shown in FIG. 1 has a hydraulic cylinder 18 is attached at one end to the lower frame member 12 and at the opposite end to the upper frame member 14 in a manner that can cause the front ends of both the upper and lower frame members simultaneously to move away from and toward each other about a common pivot point resembling the opening and closing of a set of jaws as will be described in more detail below. Base support means 40 and load support means 50 are provided at the front ends of the lower and upper frame members 12 and 14, respectively. The base support means 40 engages the ground G to support the jack 10, and the load support means 50 engages and holds the load being lifted, represented in FIG. 1 by the house H. Wheels 64 and a handle 68 are provided to enhance the convenience and maneuverability of the jack during the preliminary steps before engaging the load and the subsequent steps after the load is released. It will be appreciated from the description that follows that the jack 10 can be used to engage large loads with a minimum of ground clearance, and it can lift the load to relatively great heights above the ground without resetting.

Figure 4:
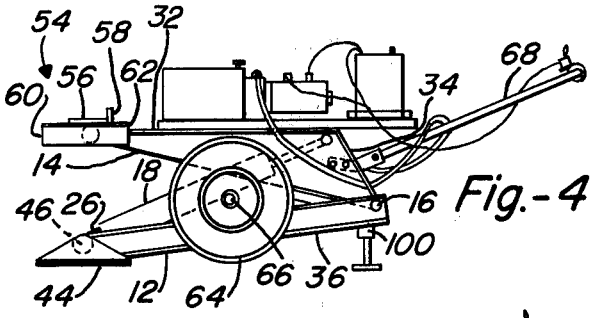
FIG. 4 is a side elevational view of the jack in a partially raised position.
Figure 2:
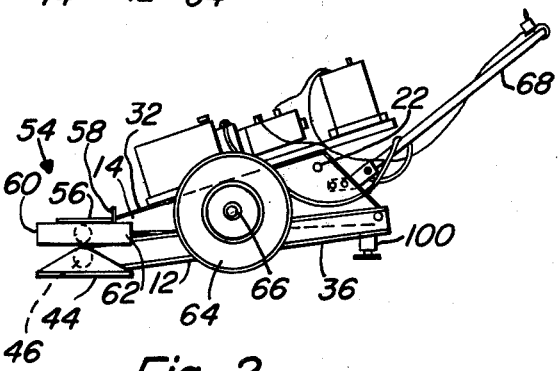
FIG. 2 is an elevation view from the opposite side showing the jack in its totally collapsed position.
Figure 3:
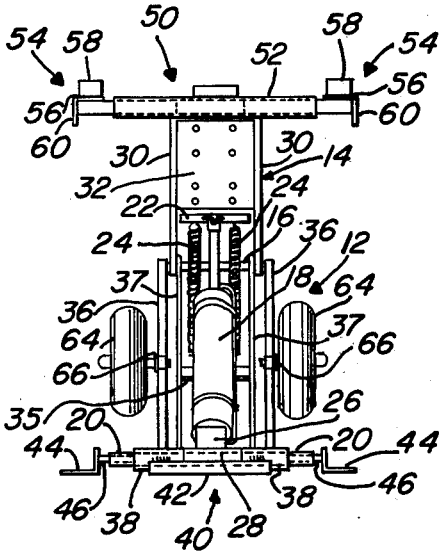
FIG. 3 is an elevation view of the front of the jack in a partially raised position.

The superstructure of the jack per se is conventional in truck-mounted hoists such as those manufactured and sold by B.B.P of Sioux City, Iowa. Broadly, the superstructure is comprised of the lower frame member 12 and the upper frame member 14 pivotally attached together at their respective rear ends by the frame shaft 16. The hydraulic cylinder 18 is pivotally attached at its lower end to the front of the lower frame member 14 by a hollow core cross shaft 20, and the opposite end of cylinder 18 is pivotally attached to the upper frame member 14 by a cylinder mounting pin 22 at a location which will be described more fully below. As best seen in FIGS. 2, 3 and 4, expanding and contracting the hydraulic cylinder 18 results in the upper and lower frame members pivoting in a scissor-like relation about frame shaft 16 resulting in the forward ends of the upper and lower frame members respectively to move apart from and toward each other, respectively, resembling the opening and closing movement of a set of jaws.

Figure 5:
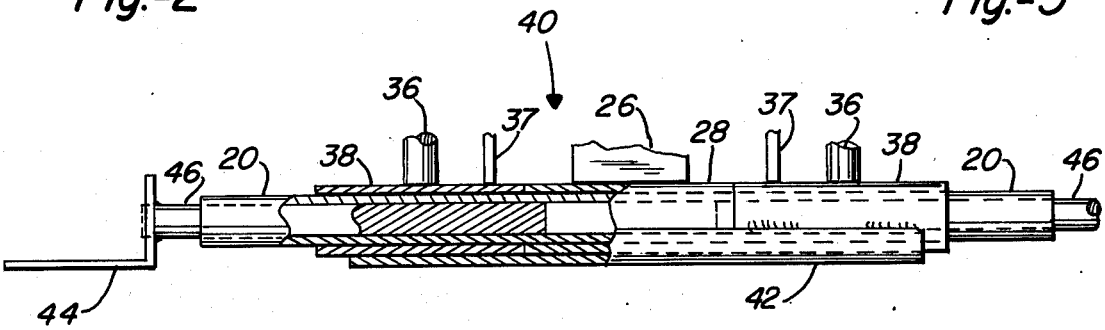
FIG. 5 is an enlarged view, partially in section, of the ground-engaging means of the invention.

The upper frame member 14 is comprised of two triangular-shaped side plates 30 rigidly held in parallel, spaced-apart relation to each other by a top plate 32 and a back plate 34. The lower frame member 12 includes two elongated strut members 36 in parallel, spaced-apart relation to each other, and two inside braces 37 positioned between said strut members 36 and in parallel, spaced-apart relation to each other and to said strut members 36. The rear ends of both the strut members 36 and the inside braces 37 are mounted on said frame shaft 16 in common with said upper frame member 14, each of said side plates 30 being mounted respectively between a strut member 36 and inside brace 37. The lower ends of said strut members 36 and said inside braces 37 are pivotally mounted on said cross shaft 20 in common with said hydraulic cylinder 18. The configuration of this common mounting can best be seen by referring to FIGS. 3 and 5 wherein the lower ends of each set of strut members 36 and inside braces 37 are rigidly attached respectively to a separate mounting sleeve 38. Mounting brackets 26 extending from the lower end of hydraulic cylinder 18 are also rigidly attached to a cylinder mounting sleeve 28 located between the lower frame mounting sleeves 38. Each of said sleeves 28 and 38 are pivotally mounted on the common cross shaft 20. An angle iron support 42 is rigidly attached on each end to the underside of each lower frame mounting sleeve 38 respectively to provide a central support base for the jack 10 and to maintain the spacing between said lower frame mounting sleeve 38 thereby increasing the stability of the lower frame member structure 14. A cross-brace 35 is rigidly attached between said inside braces 37 at about midspan on said inside braces to further enhance the stability and rigidity of the lower frame member 12.

In accordance with the present invention, the angle iron support 42 and the cross shaft 20 in conjuction with auxiliary ground-engaging support pads 44 define the primary elements of the base support means 40 which engages the ground G and supports the jack 10 in position while it is lifting a load. The ground-engaging support pads 44 are each rigidly attached to a shaft 46 which is slidably received into the hollow core of cross chaft 20. Thus, the shaft 46 can be slid in and out of the end of cross shaft 20 to allow the ground-engaging support pads 44 to be set at any of a number of positions toward and away from the lower frame member 12 thereby increasing or decreasing the overall width span of the base support means 40 as desired. Obviously, a wider setting of the span of the base support means 40 by setting the support pads 44 at longer distances from the lower frame member 12 will result in increased stability of the jack 10 by resisting side tipping while it is lifting a load. It can also be appreciated that the shafts 46 are rotatable within the cross shaft 20 thereby allowing the ground-engaging support pads 44 to maintain a flat position on the ground G while the lower frame member pivots around said cross shaft 20 from a substantially horizontal position toward a vertical position as the hydraulic cylinder 18 is extended and the load is lifted to higher positions. This rotatable feature allowing the support pads 44 to maintain a flat position also enhances the stability of the jack structure while a load is being raised.

A load-engaging support means 50 is provided at the forward end of the upper frame member 14, and it includes a hollow load shaft 52 rigidly attached to the upper frame member in parallel relation to said cross shaft 20 on said lower frame member 12. Load-engaging pads 54 are slidably and rotatably mounted in each end of said hollow load shaft 52 in a manner similar to the method of mounting said ground-engaging support pads 44 in the ends of said cross shaft 20. More specifically, a load-engaging pad 54 includes a shaft 53 slidably received in the end of said hollow load shaft 52, a seat plate 56 rigidly attached to the top of said shaft 53, a back plate 58 extending upwardly from the rear end of the seat plate 56, and a brace plate 60 rigidly attached to and extending downwardly and rearwardly from the outer edge of said seat plate 56 and over the end of said shaft 53. Said seat plate 56 is rigidly attached to the top of said shaft 53 with a substantial portion of said seat plate extending laterally on each side of said support shaft 53 so that when the bottom surface area of a load is positioned on said seat plate and in contact with said back plate, the load-engaging pads 54 will be maintained by said load in an upright position and thereby preventing the load from being accidentally tipped off the load-engaging support means 50. A rearward extension of the brace plate 60 defines a handle portion 62 which can accommodate proper setting of the support plates 50 under the load prior to lifting. Also, the pivotal mounting of support shaft 53 in the end of the hollow load shaft 52 accommodates the pivotal movement of the upper frame member 14 around said hollow load shaft 52 in a relative downward movement from the load as the hydraulic cylinder 18 is extended and the load is raised above the ground. As explained in connection with the ground-engaging support pads 44, this rotational feature allows the load-engaging pads 54 to maintain complete contact with the undersurface of the load being lifted and thereby enhances the stability and safety of the jack 10 while the load is being lifted.

As explained above, the lower end of hydraulic cylinder 18 is mounted at the very front end of lower frame member 12 on a shaft 20 commonly supporting the hydraulic cylinder 18, the ends of the lower frame member 12, and the base support means 40. The upper end of the hydraulic cylinder 18 is pivotally attached to the upper frame member 14 by the cylinder mounting pin 22 which is located toward the rear of the upper frame member 14 but forward of the frame shaft 16 and above an imaginary straight line running through the frame shaft 16 and the load shaft 52. Another way of describing the location of the connection of the upper end of the cylinder 18 to the upper frame member 14 is by noting that the upper frame member 14 is pivotally attached to the lower frame member 12 by frame shaft 16. This pivotal attachment is located at one corner of the said triangular-shaped side plates 30; the load-engaging support means 50 with the hollow load shaft 52 is located at the second corner of said triangular-shaped side plate, and the upper end of the cylinder 18 is pivotally attached near the third corner of said triangular-shaped side plate 30 by the mounting pin 22. This configuration of the frame members and the manner of attaching the frame members together and mounting the hydraulic cylinder accommodates a very compact jack structure when the jack is in a completely collapsed position as shown in FIG. 2, yet which is capable of lifting a load from a very low ground clearance to a relatively great distance above the ground without resetting, while providing a stable structure capable of safely lifting and holding a load high above the ground.

As can be seen in FIGS. 1 and 3, as the hydraulic cylinder 18 is extended, the load is lifted in a vertically straight line above the base support means 40 and the rear ends of the frame members are raised above the ground in an arcuate path while the individual upper and lower frame members pivot around the load-engaging support means 50 and the base support means 40, respectively, toward vertical orientation of said individual frame members. It can thus be appreciated that the jack can accommodate any lift line required by the load being raised in a safe and stable manner. The load is not required to conform to any arcuate lifting path defined by the jack.

For convenience in moving and handling the jack 10, wheels 64 are rotatably mounted on the lower frame member 12 just over the strut members 36 approximately midway between the base support means 40 and the frame shaft 16, and a handle 68 with hand grips 69 is rigidly attached to and protrudes from the rear end of the upper frame member between the frame shaft 16 and the cylinder mounting pin 22. As already mentioned, the wheels and handle facilitate movement of the jack to a location when not loaded and aligning it to the load; however, when the jack is tipped and advanced into alignment beneath a load the wheels advance to an out-of-the-way position and are actually lifted off the ground during lifting as can be seen in FIG. 1. To accomplish this feature, the diameters of the wheels must be proportioned and coordinated with the actual location of the wheel mounting on the lower frame member. For example, larger diameter wheels would have to be mounted more rearwardly and perhaps higher above the strut members 36 than smaller diameter wheels. Further, with the base support means 40 firmly planted on the ground G and held there by the weight of the load being lifted, the jack cannot be moved. On the contrary, when the ground is engaged by the base support means 40 and the load engaged by the load-engaging support means 50, the jack takes on a very rigid and immovable position remaining quite stable throughout the entire lifting operation.

Figure 6:
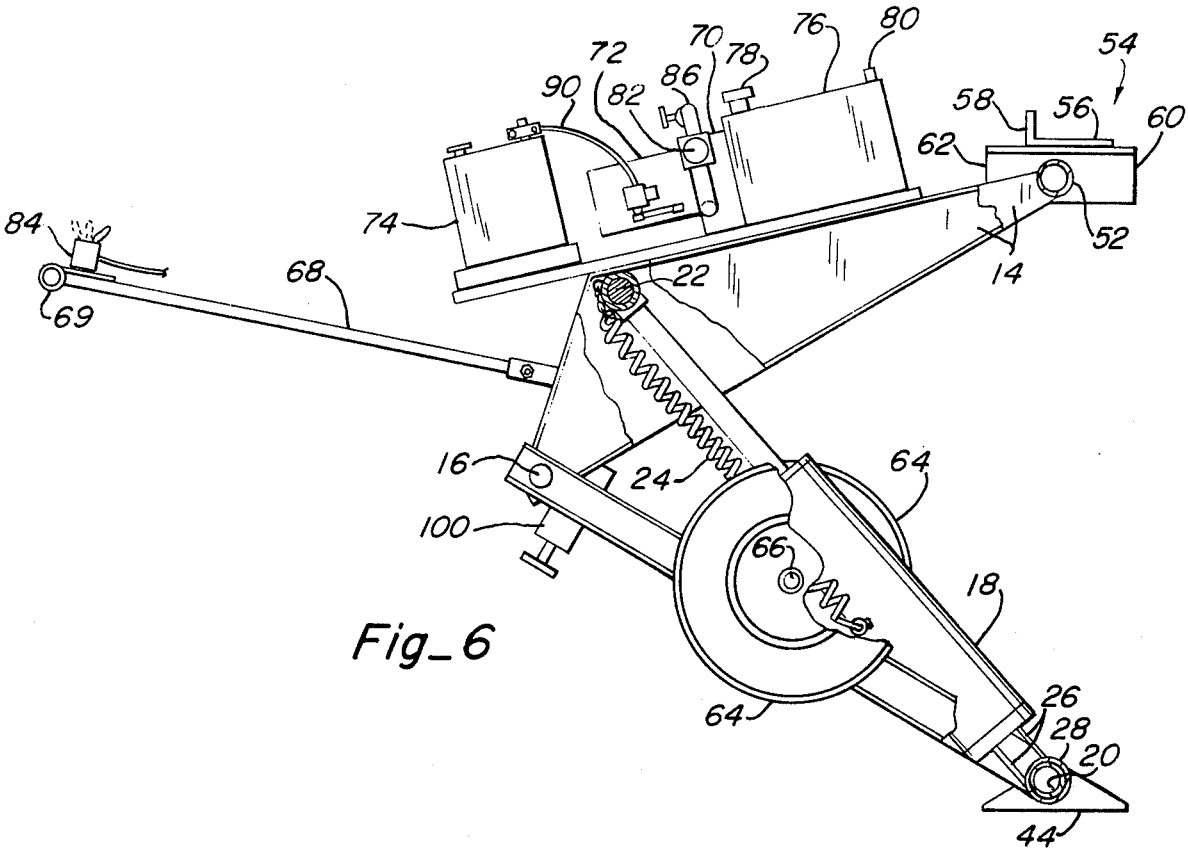
FIG. 6 is an enlarged sectional view of the jack illustrating the pivotal connections of the several components as well as the control mechanism.

The jack is equipped with a self-contained power unit mounted on top of the upper frame member 14 with control mechanism and circuits for the convenience of the operator. The power drive mechanism and control apparatus are most easily described by reference to FIG. 6 taken in conjunction with the schematic diagrams in FIGS. 7, 8 and 9. A hydraulic pump 70 driven by electric motor 72 draws hydraulic fluid from reservoir 76 and forces it under pressure through appropriate hydraulic flow lines 88 to hydraulic cylinder 18. Of course, as is obvious to one skilled in the art, the hydraulic fluid in cylinder 18 forces the ram of cylinder 18 to be extended thereby causing the "jaws" or frame members of the jack to open as described above. A battery 74 provides electric power to the motor 72 through appropriate electric circuits 90. A double-acting electric switch 84 is mounted in a convenient position on handle 68 for controlling the motor 72 and the three-way valve 82.

Figure 7:
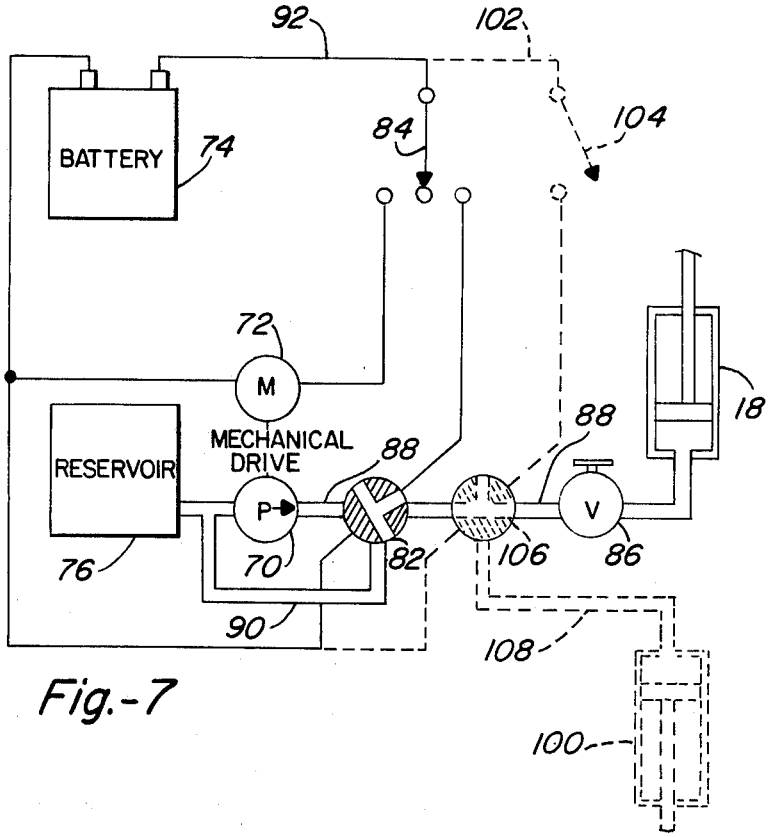
FIG. 7 is a schematic diagram of the control mechanism.
Figure 8:
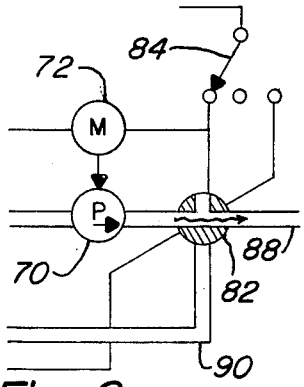
FIG. 8 is a segment of the schematic diagram shown in FIG. 7, but illustrating the lift mode.

The switch 84 and the valve 82 are shown in FIG. 7 in a position indicating an inactive or hold status of the jack with the valve 82 preventing any flow of hydraulic fluid in either direction through flow line 88. The segment of the schematic diagram shown in FIG. 8 indicates the position of the switch 84 and the valve 82 when the jack is in a lift mode. As seen in FIG. 8, the switch 84 supplies electric current to the motor terminal and to the valve 82. The motor 72 is started thereby operating the pump 70 and the valve 82 is positioned to allow the pump 70 to force hydraulic fluid straight through the valve 82 and into the hydraulic cylinder 18 as indicated by the directional flow arrow.

Figure 9:
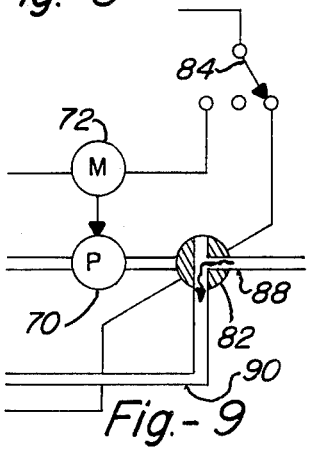
FIG. 9 is also a segment of the schematic diagram in FIG. 7, but illustrating the down mode.

The segment of the schematic diagram in FIG. 9 illustrates the jack in a lowering or down mode. In the down mode, no electric power is provided to the motor 72 but the three-way valve 82 is positioned to allow the hydraulic fluid to flow back from the hydraulic cylinder 18 through the return flow line 90 and into the reservoir. Obviously, this backward flow of the fluid out of the cylinder 18 allows the ram of cylinder 18 to contract into the cylinder resulting in the closing of the jaws or frame members of the jack and lowering the load.

It is desirable to have a means of controlling the speed of the movement of the jack both in the lift mode and in the down mode, but it is particularly necessary to have such a speed control in the down mode since a very heavy load could cause the jack to collapse much too quickly and endanger the safety of the load and persons in the vicinity. Consequently, a speed control valve 86 is provided in the flow line 88 which can be set manually to restrict the flow of hydraulic fluid through the line 88 to any desired degree. For example, when a heavy load is to be lowered, the speed control valve 86 can be manually set to severly restrict the backflow of hydraulic fluid from the cylinder 18 into the reservoir 76. In this way, the jaws or frame members of the jack will be allowed to collapse and lower the load only very slowly. Alternately, when the load on the jack is very light, it may be necessary to open the speed valve 86 in order to lower the load at a reasonable speed. Obviously, the speed control valve 86 is also capable of varying the speed in the lift mode by effecting similar variations in the restriction of the flow of hydraulic fluid as described above.

Return bias springs 24 are also provided in association with the lift means to collapse or lower the jack under very light load or no load conditions. One end of each spring is attached to a side of the hydraulic cylinder 18 at about midspan, and the opposite end of each spring is attached to the end of the ram and biased to force the ram into the cylinder 18. Of course, the use of a double-acting hydraulic cylinder could accomplish the same function by forcing the jack to collapse under light load or no load conditions with some modification of the control apparatus and circuit.

An optional feature of the jack which may be added for convenience in aligning the load support means 50 with a load after the base support means 40 is set in place directly under the desired point of lifting includes a hydraulic cylinder 100 attached to the rear end of the lower frame member 12 with an axially extendable and contractable ram pointing downward when the jack is in the collapsed position. When the ram of this alignment cylinder 100 is extended, it will contact the ground and force the back end of the jack 10 upward causing the base support means 40 to securely engage the ground G while the wheels 64 are lifted off the ground and further causing the load support means 50 of the jack 10 to be thrust forward into the desired position under the load. Thus it can be appreciated that the alignment cylinder assists in aligning the jack without the necessity of the operator lifting on the handle 68 to align the load support means 50 under the load as he would otherwise have to do.

Although there are several conceivable electric and hydraulic circuits to accommodate this optional alignment cylinder feature, one convenient circuit is shown in phantom lines to distinguish it from the primary circuit in FIG. 7. An additional three-way flow valve 106 is provided in the hydraulic flow line 88 downstream from the three-way valve 82. An additional electric switch 104 is mounted on the handle 68 and provided with an electric circuit 102 for activating the valve 106 to divert the flow of hydraulic fluid from flow line 88 to flow line 108 into the alignment cylinder 100. As soon as the flow of hydraulic flow is diverted in the aforesaid manner into the flow line 108. The up, down and hold modes of the alignment cylinder 100 can be controlled with switch 84, valve 82, and the motor 72 and pump 70 in the same manner as described above for the control of the main jack hydraulic cylinder 18. It can be appreciated then that an operator can quickly and easily alternate the operation back and forth between the main cylinder 18 and the alignment cylinder 100 simply by opening and closing the circuit 102 with the switch 104. In this manner, the jack 10 can be easily and conveniently aligned in the proper position under a load for lifting.

Although the present invention has been described with a certain degree of particularity, it is understood that the present disclosure has been made by way of example and that changes in details of structure may be made without departing from the spirit thereof.

What is claimed is:

1. A portable jack apparatus for raising and lowering bulky objects, comprising:

a lower frame member;

an upper frame member, said upper and lower frame members being of approximately equal length and being pivotally attached together at a common transverse axis at their respective rearward ends;

an axially expandable and contractable lift means pivotally attached between said upper and lower frame members for alternatively pivoting said forward ends of said upper and lower frame members away from and toward each other about said common transverse axis to raise and lower said jack apparatus;

load support means on the forward end of said upper frame member for supporting a load on the jack apparatus;

base support means on the forward end of said lower frame member for supporting the jack apparatus as a load is being supported by said load support means;

drive means mounted on said jack apparatus for driving said lift means;

wheels rotatably mounted on said lower frame member between said base support means and said common transverse axis, the diameters of said wheels being proportioned and coordinated with their actual location of mounting such that the weight of the jack apparatus is carried by said wheels when no load is being supported by said load support means and is transferred to said base support means when a load is being supported by said load support means; and elongated handle means extending in a rearward direction from a location adjacent to the rearward ends of said frame members and terminating in main control means for controlling said drive means at a position remote from said frame members whereby said jack apparatus can be manuevered into place under a load and operated by said main control means to engage the load and transfer support of the weight from said wheels to said base support means from a position spaced rearwardly of and away from said frame members.

2. The portable jack apparatus of claim 1, wherein said lift means is mounted on the upper surface of said upper frame member and includes a hydraulic cylinder with an axially extending and contracting ram, said drive means includes a pump for supplying hydraulic fluid under pressure to said hydraulic cylinder, and a hydraulic fluid reservoir, and said control means is operative to control the flow of said fluid to and from said hydraulic cylinder to extend said ram thereby raising said load support means for holding said ram in any selected position throughout its range of operation, and for contracting said lift means thereby lowering said load support means.

3. The portable jack apparatus of claim 2, wherein said handle means is rigidly attached to and extends from the rearward end of said upper frame member a sufficient length and at a constant angle to the longitudinal axis of said upper frame member such that rotation of said upper frame member about said common transverse axis is imparted to said handle means, whereby the rotation of said handle means about said common transverse axis as said jack apparatus is raised and lowered results in a vertical component of movement at the distal end of said handle means sufficient to compensate for the oppositely directed vertical component of movement imparted to said upper frame member and said handle means by the rearward end of said lower frame raising and lowering as said jack apparatus is raised and lowered to maintain the distal end of said handle means at a substantially constant level for an operator throughout the range of operation of the jack.

4. The portable jack apparatus of claim 2, including an axially expandable and contractable alignment means attached under the rear end of said lower frame member for transferring the weight of said jack apparatus from said wheels to said base support means while aligning said load support means to a load.

5. The portable jack apparatus of claim 3, 3 wherein said main control means includes an electrically operated valve for selectively directing and stopping the flow of hydraulic fluid and electric switch means mounted near the distal end of said handle means for actuating said valve and for selectively starting and stopping said motor.

6. In a lifting apparatus for lifting bulky objects wherein an upper frame member and a lower frame member are pivotally attached together at a common transverse axis at their respective rear ends, with an axially expandable and contractable lift means pivotally attached between said upper and lower frame members for selectively pivoting said forward ends of said upper and lower frame assemblies away from and toward each other about said common transverse axis, the improvement comprising:

load support means at the forward end of said upper frame member for supporting a load on the lifting apparatus;

base support means at the forward end of said lower frame member for supporting the lifting apparatus as a load is being supported by said load support means, said base support means including a cross shaft and two ground-engaging pads each of which is pivotally and telescopically mounted on opposite ends of said cross shaft, respectively, in transversely adjustable relation to said lower frame member, whereby the effective transverse span of said base support means is adjustably expandable and contractable and said ground-engaging pads remain in constant unmoving contact with the ground as said lowwer frame member pivots upwardly and downwardly about said base support means throughout the lifting apparatus' range of operation to enhance stability of the lifting apparatus.

7. The lifting apparatus of claim 6 wherein said lift means includes a hydraulic cylinder with an axially extending and contracting ram, said ram having a transverse hollow sleeve at its distal end pivotally attached to said upper frame member by a transverse mounting pin extending from one side of said upper frame member through said transverse hollow sleeve to the opposite side, and the distal end of said cylinder being pivotally mounted on said cross shaft, and contracting means attached to and extending between said transverse hollow sleeve and the side of said cylinder normally biased for urging said ram to contract with respect to said cylinder.

8. The lifting apparatus of claim 6, including wheels rotatably mounted on said lower frame member between said base support means and said common transverse axis for carrying the weight of said lifting apparatus when a load is not being supported on said load support means, and a handle rigidly attached to and extending rearwardly from an inclined surface at the rear end of said upper frame member a sufficient length and at a constant angle to the longitudinal axis of said upper frame member such that rotation of said upper frame member about said common transverse axis is imparted to said handle, whereby the rotation of said handle about said common transverse axis as said lifting apparatus is raised and lowered results in a vertical component of movement at the distal end of said handle sufficient to substantially nullify the oppositely directed vertical component of movement imparted to said upper frame member and said handle by the rearward end of said lower frame member raising and lowering as said lifting apparatus is raised and lowered to maintain the distal end of said handle to a substantially constant height throughout the range of operation of the lifting apparatus.

9. The lifting apparatus of claim 6, wherein said load support means includes a hollow load shaft rigidly attached to said upper frame member, and two load-engaging pads, each of said load-engaging pads being pivotally and slidably mounted in opposite ends of said hollow load shaft, and each of said load engaging pads including a horizontal support shaft, a flat seat plate rigidly attached at its midspan on top and toward one end of said support shaft with a substantial portion of said seat plate extending on each side of said support shaft, a back plate extending upward from and rigidly attached to the rear end of said seat plate, and a brace plate extending downward from the outer side of said seat plate and across the end of said support shaft and with the rear end of said brace plate extending under and rearwardly beyond said back plate to provide a handle convenient for positioning said load-engaging pad under the handle convenient for positioning said load-engaging pad in a desired location under the object to be lifted.

10. The lifting apparatus of claim 6, including powered drive means for extending said lift means to raise said load support means, a power source for powering said drive means, and main control means for activating said drive means, for extending said lift means thereby raising said load support means, for holding said lift means in one position, and for contracting said lift means thereby lowering said load support means, said drive means, power source, and control means all being integrally mounted on the lifting apparatus whereby said lifting apparatus is self-contained for convenience and utility in use and in storage and transportation.

11. The lifting apparatus of claim 6, including axially expandable and contractable alignment means attached under the rear end of said lower frame assembly for positioning said load support means under the object to be lifted.

12. The portable jack apparatus of claim 4, including alternate control means interconnected with said main control means for diverting the flow of hydraulic fluid from said lift means to said alignment means whereby said main control means can also activate said alignment means, extend said alignment means, hold said alignment means in one position, and contract said alignment means.

13. The portable jack apparatus of claim 5, including speed control means interconnected with said main control means for varying the speed at which said load support means is raised and lowered.

14. In a jack apparatus for lifting large objects having a lower frame assembly and an upper frame assembly pivotally attached together at their respective rearward ends, said lower frame assembly including a pair of elongated strut members in parallel, spaced-apart relation to each other, the combination of:

base support means at the forward end of said lower frame assembly and load support means at the forward end of said upper frame assembly, said base support means including a cross shaft, one end of said cross shaft being attached to one of said strut members and the opposite end of said cross shaft being attached to the other said strut member;

an elongated, axially extending and contracting fluid driven lift means for selectively pivoting said forward end of said upper and lower frame assemblies away from and toward each other, one end of said lift means being pivotally mounted on said cross shaft between said strut members, and the opposite end of said lift means being pivotally mounted between said forward and rear end of said upper frame assembly;

a pair of wheels, each of which is rotatably mounted on opposite of said strut members rearwardly of said base support means, said wheels being of such a diameter and mounted in such a location that they carry the weight of said jack when it is in a collapsed position but that they are lifted off the ground when a load is engaged and said jack is expanded;

handle means attached to the rear end of said jack for maneuvering said jack when collapsed and for lifting the rear end of said jack to transfer the weight from said wheels to said base support means and to align said load support means with a load;

electrically powered fluid drive means mounted on said upper frame assembly for supplying fluid to said lift means; and control means mounted on said handle means for actuating said drive means to extend said lift means thereby raising said load support means, for holding said lift means in any selected position throughout its range of operation and for contracting said lift means thereby lowering said load support means.

15. The jack apparatus of claim 14, including axially expandable and contractable alignment means attached under the rear end of said jack for tipping said jack by lifting its rear end to transfer the weight from said wheels to said base support means and to align said load support means with a load.

16. The jack apparatus of claim 14 wherein said lower and upper frame assemblies are of substantially the same length as each other and are pivotally attached together at their rearward ends at a common transverse axis, and said load support means is always substantially vertically above said base support means throughout its range of movement whereby an object to said load support means will be lifted in substantially a vertically straight lift line with perhaps a slight arc as defined by the objects being lifted.

17. The jack apparatus of claim 14, wherein the upper end of said lifting means is pivotally connected to said upper frame assembly at a location in spaced relation above a straight line extending through said load support means and the location of the common axis where said lower and upper frame assemblies are pivotally connected together.

18. The jack apparatus of claim 16, wherein said base support means includes a ground-engaging pad pivotally mounted on said lower frame assembly, whereby said pad remains in constant unmoving contact with the ground as said lower frame assembly pivots upwardly and downwardly about said base support means throughout its range of operation to enhance stability of the jack.

19. The jack apparatus of claim 14, wherein said load support means includes a load engaging pad pivotally and telescopically mounted on said upper frame assembly for transverse adjustment of the load engaging pad in relation to said upper frame assembly.

* * * * *